US005896783A

United States Patent [19]

Letzel

[11] Patent Number: 5,896,783

[45] Date of Patent: Apr. 27, 1999

[54] SAFETY SWITCH DEVICE

[75] Inventor: Helmut Letzel, Cologne, Germany

[73] Assignee: K. A. Schmersal GmbH & Co., Wuppertal, Germany

[21] Appl. No.: 08/754,841

[22] Filed: Nov. 22, 1996

[30] Foreign Application Priority Data

Nov. 24, 1995 [DE] Germany ..... 195 43 769
Aug. 16, 1996 [DE] Germany ..... 196 32 963

[51] Int. Cl.[6] ..... F16H 53/00

[52] U.S. Cl. ..... 74/567; 74/569; 74/568 T; 200/33 B

[58] Field of Search ..... 74/567–569; 200/38 R, 200/38 A, 38 F, 38 B, 33 B

[56] References Cited

U.S. PATENT DOCUMENTS

| | | | |
|---|---|---|---|
| 1,564,207 | 12/1925 | Cloud | 200/48 |
| 3,316,367 | 4/1967 | Kowalski | 200/48 |
| 3,440,373 | 4/1969 | Blewitt | 200/61.7 |
| 3,602,662 | 8/1971 | Haller | 200/61.62 |
| 3,689,718 | 9/1972 | Gorsuch . | |
| 4,789,761 | 12/1988 | Malone et al. | 74/568 T X |
| 5,241,873 | 9/1993 | Hormann | 74/569 X |
| 5,439,252 | 8/1995 | Oxley et al. | 74/493 |

FOREIGN PATENT DOCUMENTS

| | | | |
|---|---|---|---|
| 596433 | 4/1960 | Canada | 74/568 T |
| 0342260 | 11/1989 | European Pat. Off. . | |
| 1553550 | 1/1966 | Germany . | |
| 2337027 | 2/1975 | Germany . | |
| 2655540 | 6/1977 | Germany | 74/568 T |
| 40 13 994 A1 | 11/1991 | Germany . | |
| 1271010 | 4/1972 | United Kingdom | 74/568 T |
| 2225826 | 6/1990 | United Kingdom . | |

*Primary Examiner*—Vinh T. Luong
*Attorney, Agent, or Firm*—Alix, Yale & Ristas, LLP

[57] ABSTRACT

A safety switch device for monitoring the position of a protective cover, the cover being pivotable about an axis into and out of a closed position. The safety switch device includes a fixed position switch unit which houses at least a first electrical signal generator which will be switched between states in response to movement of the protective cover from the closed position, the signal generator being operated by an actuator which rotates about an axis. The switch device also includes a fastener element which is adjustably mountable to the protective cover and an articulated mechanical coupling which extends between the fastener element and the signal generator actuator, the coupling element being movable in at least two planes.

20 Claims, 10 Drawing Sheets

SAFETY SWITCH DEVICE

BACKGROUND OF THE INVENTION (1) Field of the Invention

The present invention relates to enhancements in security devices and, particularly, to the generation of signals commensurate with the state of a mechanical closure member through which access to a secured device or area is obtained. More specifically, this invention is directed to an improved safety switch unit and, especially, to a signal generator for monitoring the position of a protective cover and providing command and/or control signals commensurate with whether that cover is in an open or closed condition. Accordingly, the general objects of the present invention are to provide novel and improved methods and apparatus of such character.

(2) Description of the Prior Art

Devices for monitoring the position of protective covers, and producing command signals which energize a warning device and/or activate a disabling device, are well-known in the art. By way of example, German Patent 1,553,550 discloses a stop device for a damper which opens via a heat-sensitive cut-out. In this prior art device, a holder for a stop bolt is affixed to the inside of the damper, the stop bolt being movably mounted in the holder and being normally blocked by a stop member. When the cut-out is released, the stop member enables the stop bolt to move either under the influence of gravity or in response to a spring bias. However, in this rather primitive early device, there is no provision for monitoring the open and closed positions of the damper.

Another example of the prior art is disclosed in published German Patent Application 40 13 994. This published application is directed to a safety switch, which is associated with a door or the like, the door rotating about a shaft. The safety switch is provided with a disk-shaped actuating cam. This actuating cam also rotates about the shaft, in response to movement of the door, and simultaneously actuates, via tappets, a pair of switches. In the safety switch of the published application, the actuating cam is seated on the shaft about which the door rotates and, accordingly, both assembly of the device and subsequent adjustment for proper operation are difficult. Indeed, such difficulties seriously limit the ability to retrofit existing protective covers with such a prior art safety switch device.

SUMMARY OF THE INVENTION

The present invention overcomes the above briefly-discussed and other deficiencies and disadvantages of the prior art and, in so doing, permits the state of a protective cover, which is pivotable about an axis between open and closed positions, to be monitored. Apparatus in accordance with the present invention is easy to assemble and to adjust because it employs a connection technique wherein alignment between the axis of rotation of the switch actuator, having a fixed location on a stationary member, and a fastening element, mounted for rotation with the protective cover, is not required. This connection technique is implemented by an articulated motion transmitting mechanism which is movable in at least two planes.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENTS

Figure 1:
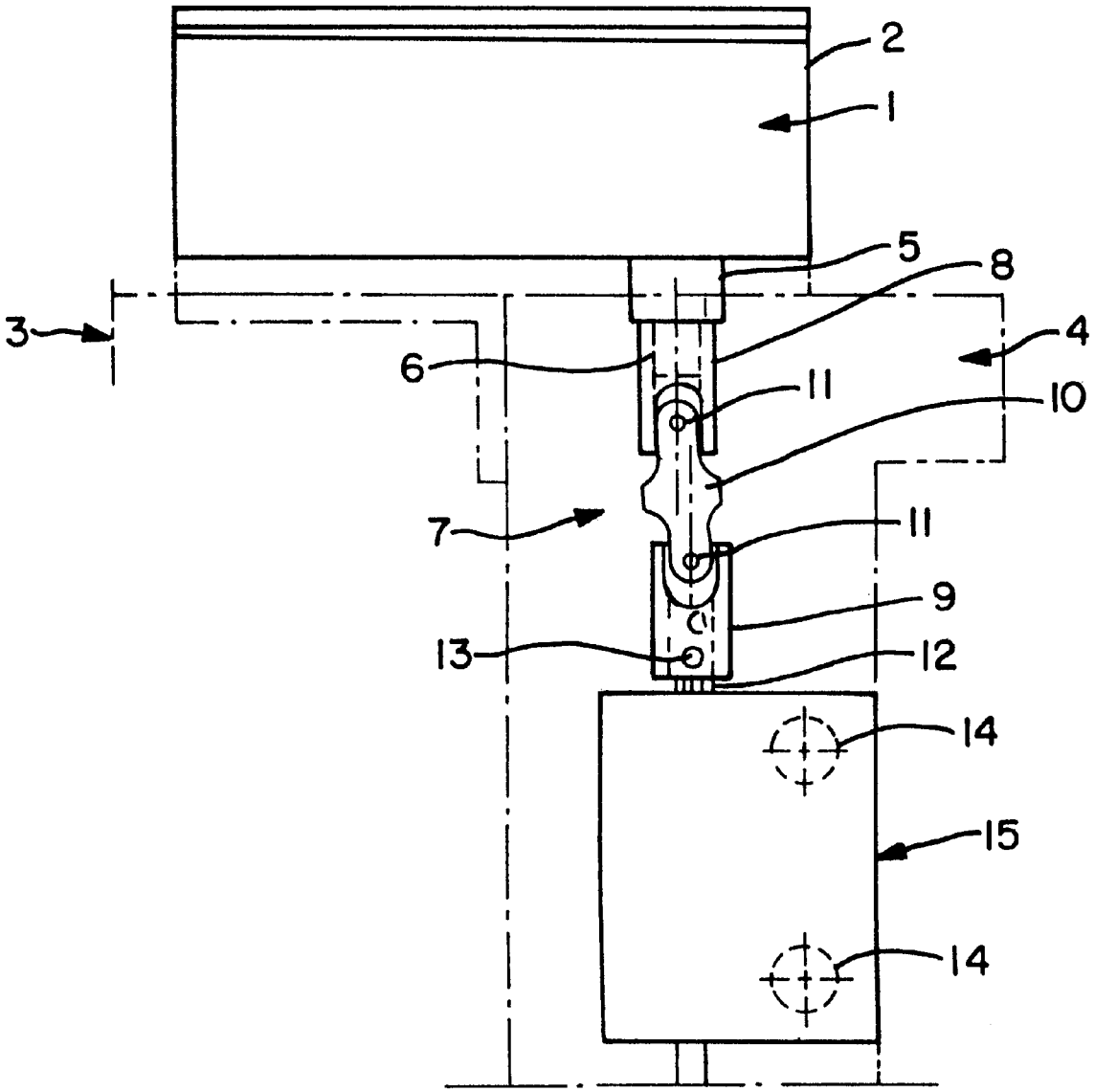
FIG. 1 is a side elevation view of a safety switch device in accordance with a first embodiment of the present invention, FIG. 1 illustrating installation of the switch device in a first working environment.
Figure 2:
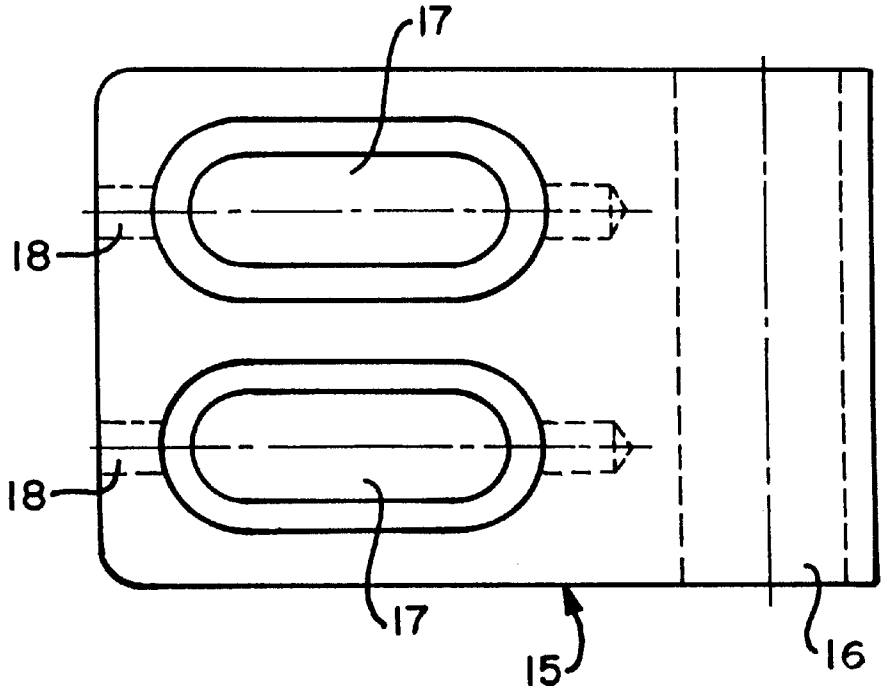
FIGS. 2 and 3 respectively depict a side view and a top view of a fastening element which may form a part of the safety switch device of FIG. 1.
Figure 3:
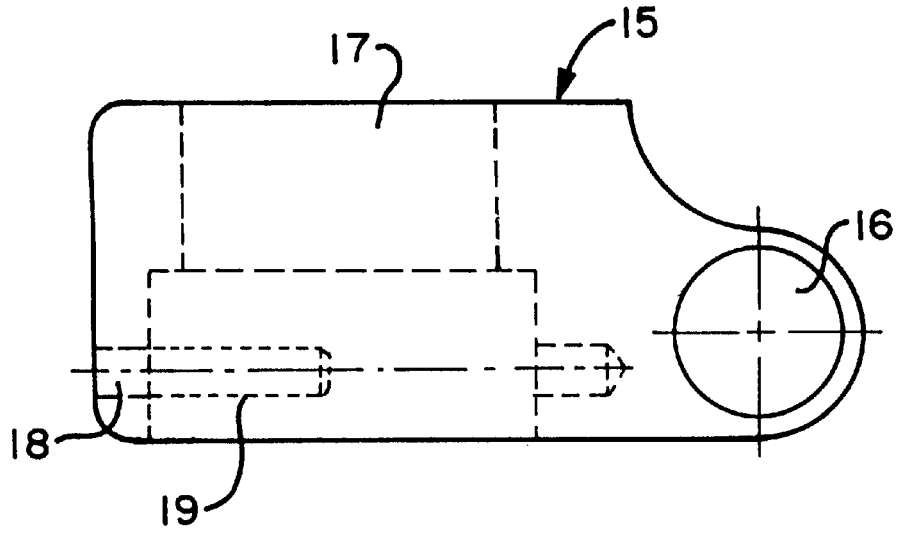

With reference first to FIGS. 1–3, a safety switch device in accordance with the present invention generally comprises a switch unit 1, an articulated mechanical connecting mechanism 7 and a fastening element 15. The switch unit 1 includes a housing 2 for one or more bistable signal generators, i.e., electrical switches, and an actuator therefor. A switch actuator which is operated by connecting mechanism 7 will be described in detail below in the discussion of FIGS. 4 and 5. Housing 2, in the embodiment being described, is affixed to a stationary component, indicated generally at 3. Component 3 may, for example, be the frame of a machine having a protective cover 4. Protective cover 4 may, for example, be employed to prevent unauthorized or untimely access to a machine housing, operating machinery or some other hazardous space. The protective cover 4 is pivotable about the axis of an actuating shaft 5 between open and closed positions. Protective cover 4 may, for example, take the form of a protective door, a protective window, a gate or a safety flap. The shaft 5, which defines the axis about which cover 4 pivots, is mounted in, and projects from, the housing 2. The shaft 5 is, in the embodiment being described, provided with a reduced diameter end portion 6. The connecting element 7 engages portion 6 of shaft 5 in an articulated manner in at least two planes. As shown in FIG. 1, this articulated mechanical connection is achieved through the use of a Cardan joint defined by a pair of sleeves 8 and 9 interconnected via an intermediate member 10 through a pair of universal joints 11.

The sleeve 8 of connecting element 7 receives the reduced diameter end portion 6 of shaft 5 and, if appropriate, is additionally secured to the shaft by means of a pin or the like. Sleeve 9, at the opposite end of the connecting element 7 from sleeve 8, receives an axle 12 which is preferably provided with longitudinal grooves along at least a portion of its exterior. A setscrew 13 is employed to lock sleeve 9 to axle 12 and, in so doing, to establish the desired longitudinal relationship between sleeve 8 and axle 12. As will be obvious to those skilled in the art, the above-described arrangement will result in rotation of axle 12 producing rotation of sleeve 8 even though the axes of rotation of axle 12 and sleeve 8 are not coaxial.

Axle 12 is mounted to fastening element 15 which, in turn, is affixed to the protective cover 4 by means of a pair of mounting bolts 14. Fastening element 15, accordingly, is a support member for mounting axle 12 so that the axle moves in response to pivotal movement of cover 4. Axle 12 is received in a bore 16 (FIG. 2) of fastening element 15, the bore 16 being located in proximity to one side edge of fastening element 15. The axis of the bore 16 is oriented so as to be generally parallel to the axis of actuating shaft 5 with the apparatus in the assembled condition depicted in FIG. 1 although deviations from such parallelism are permitted. Relative rotation between axle 12 and fastening element 15 may be prevented in any desired manner.

Referring to FIG. 2, a fastening element 15 for use in practice of the invention may be provided with a pair of elongated slots 17 which, in their longest dimension, are oriented generally transversely with respect to the axis of bore 16. The slots 17 receive the mounting bolts 14 and permit adjustment of the position of the fastening element in a first direction.

The slots 17 are provided, adjacent one side of fastening element 15, with enlargements which define shoulders. These enlargements receive the heads of the mounting bolts 14 so that the bolt heads may be countersunk to be flush with the outer surface of the fastening element.

The fastening element 15 is also provided with a pair of parallel blind holes 18 which, as may be seen from FIG. 2, intersect the slots 17 and extend completely across the slots in the direction of the axle receiving bore 16. The axis of bore 16 lies in a plane defined by the axes of holes 18, this plane being transverse to the longitudinal axes of slots 17 and thus also being transverse to the axes of bolts 14. Securing pins 19, one of which is identified in FIG. 3, are received in the blind holes 18. The pins 19 and holes 18 are provided, at least partially, with complementary threads. The pins 19 thus function as set screws which engage the sides of mounting bolts 14 and prevent rotation thereof. Thus, once the proper position of the fastening element 15 has been found, bolts 14 and set screws 19 are tightened to lock fastening element 15 in that position.

The switch unit 1 is actuated, i.e., the state of the electrical signal generators within housing 2 is caused to change, in response to the pivoting of protective cover 4 between open and closed positions. Restated, motion of the protective cover 4 is transmitted to switch unit 1 by means of the connecting element 7. Any deviations between the alignment of actuating shaft 5 and axle 12 will be compensated by the Cardan joint connecting element 7. Accordingly, a safety switch device in accordance with the present invention may readily be mounted on existing equipment and can easily be adjusted once installed.

Figure 4:
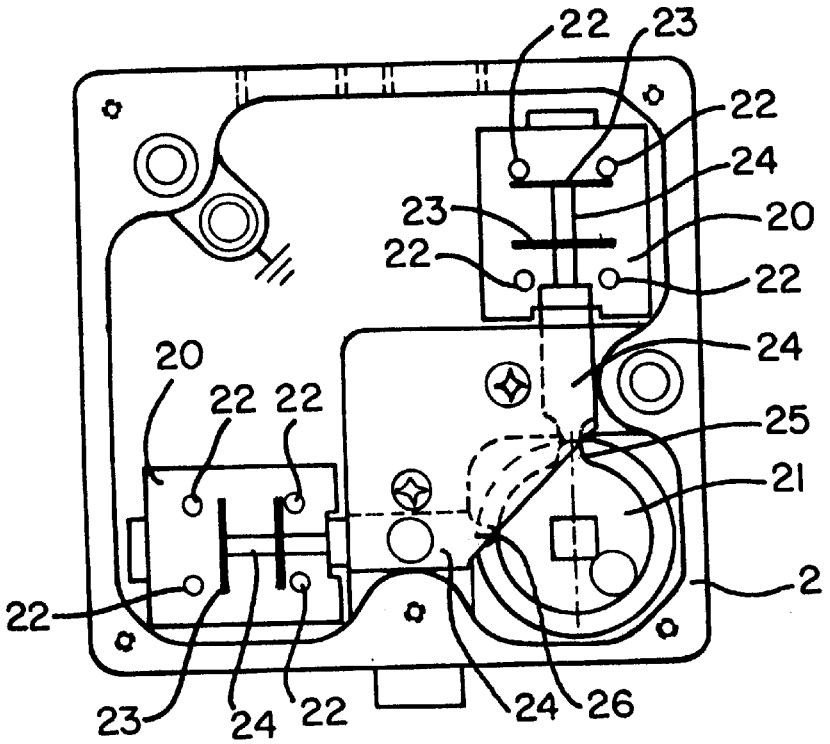
FIGS. 4 and 5 are schematic top plan views of a first embodiment of a switch unit of the safety switch device of FIG. 1, FIGS. 4 and 5 showing the switch unit in different operative states corresponding to different positions of an associated protective cover.
Figure 5:
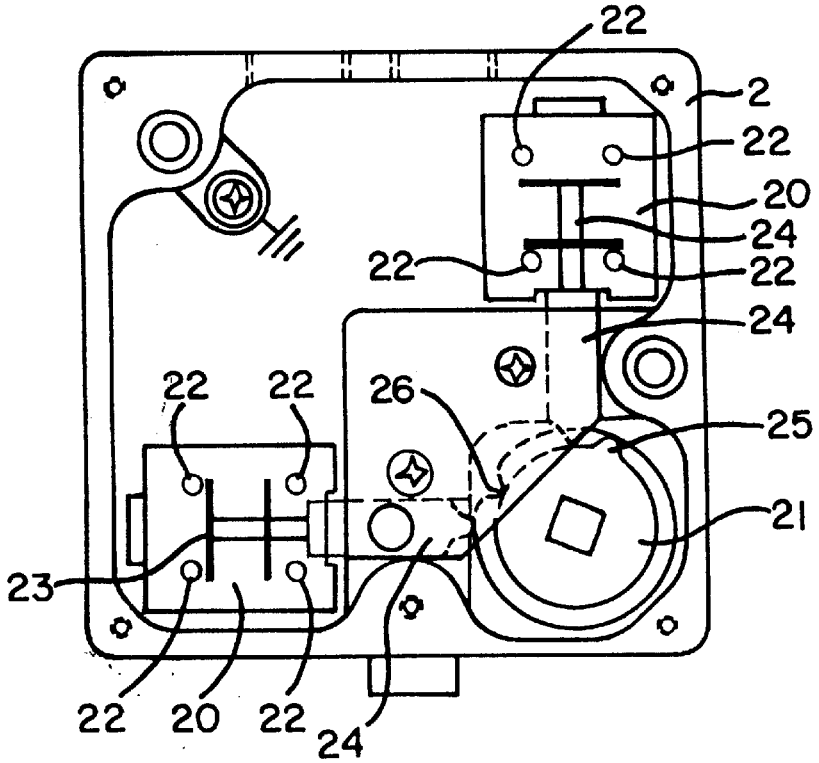

The embodiment of the switch unit 1 depicted in FIGS. 4 and 5 utilizes a pair of double pole, double throw electromechanical switches 20. The switches 20 are actuated via a disk-shaped actuating cam 21 which is mounted on shaft 5 and thus rotates in response to movements of cover 4. One of switches 20 may be employed to monitor the open position of the protective cover while the other of switches 20 may be employed to generate a signal commensurate with the closed position of cover 4. The switches 20 of the embodiment being described each have two pairs of fixed contacts 22 which may alternatively be bridged by movable contacts 23, i.e., contact bridges, carried by actuator tappets 24. The position of the actuator tappets 24 is controlled by the cam 21. Thus, cam 21 is provided, in planes arranged axially one above the other, with a projection 25 and a detent notch 26, the projection and notch being offset from one another by 90° in the disclosed embodiment. The tappets will typically be biased, for example by springs not shown, against cam 21. In one reduction to practice, the state of the switches 20 varied between the condition depicted in FIG. 4 and that depicted in FIG. 5 in response to a 3° rotation of cam 21.

Figure 6:
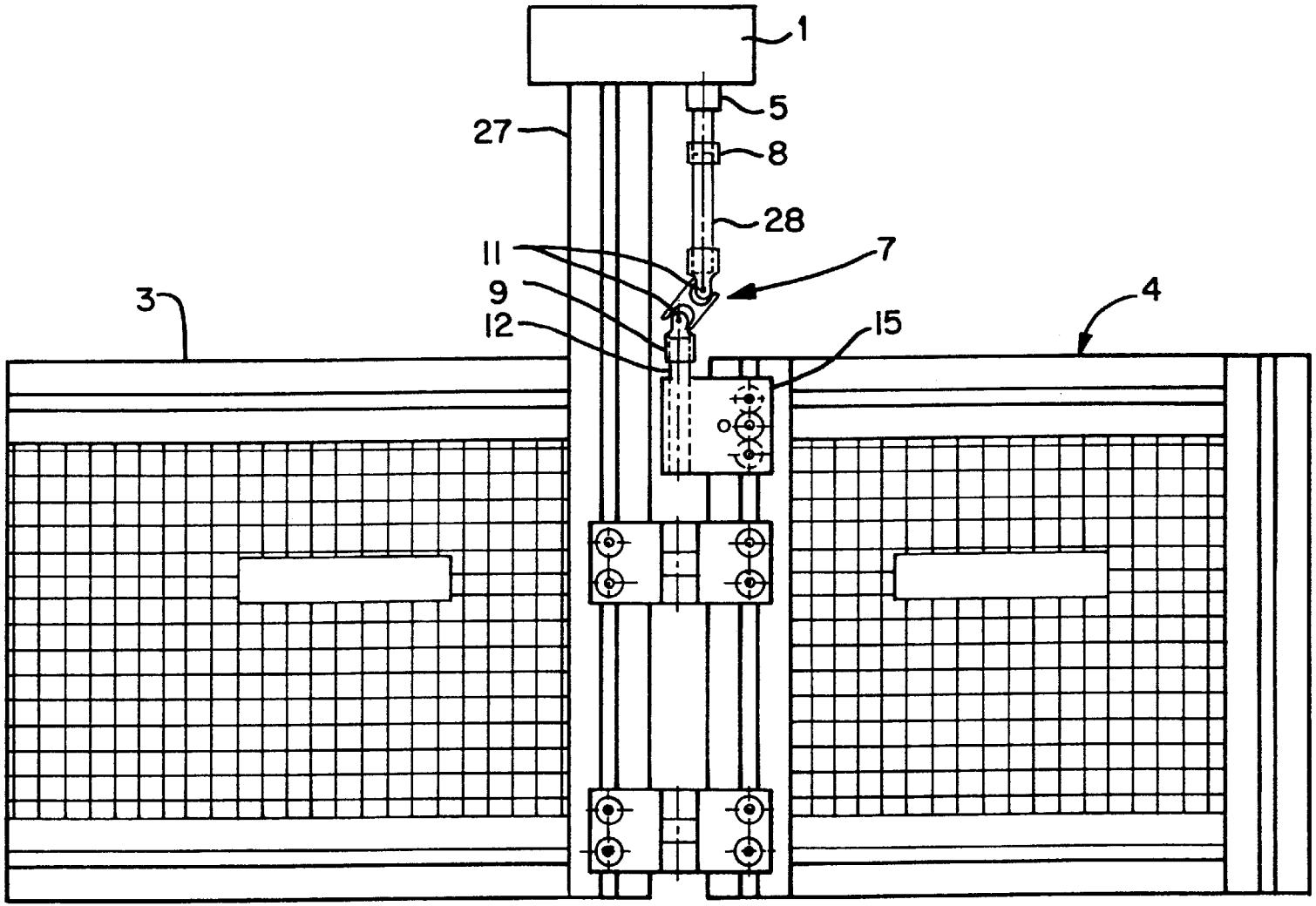
FIGS. 6 and 7 are views similar to FIG. 1 which respectively depict two additional possibilities for assembling and installing a safety switch device in accordance with the present invention.

FIG. 6 illustrates how a safety switch device in accordance with the present invention could be installed. In FIG. 6, the switch unit 1 is mounted on the upper end of a post 27 and the connecting element 7 includes an extension shaft or axle 28 for connecting the cardan joint structure to the upper sleeve 8, i.e., the upper of the universal joints 11 of the cardan connection is, in the FIG. 6 installation, displaced from sleeve 8. In FIG. 6, the protective cover 4 is depicted as the gate portion of a fence 3.

Figure 7:
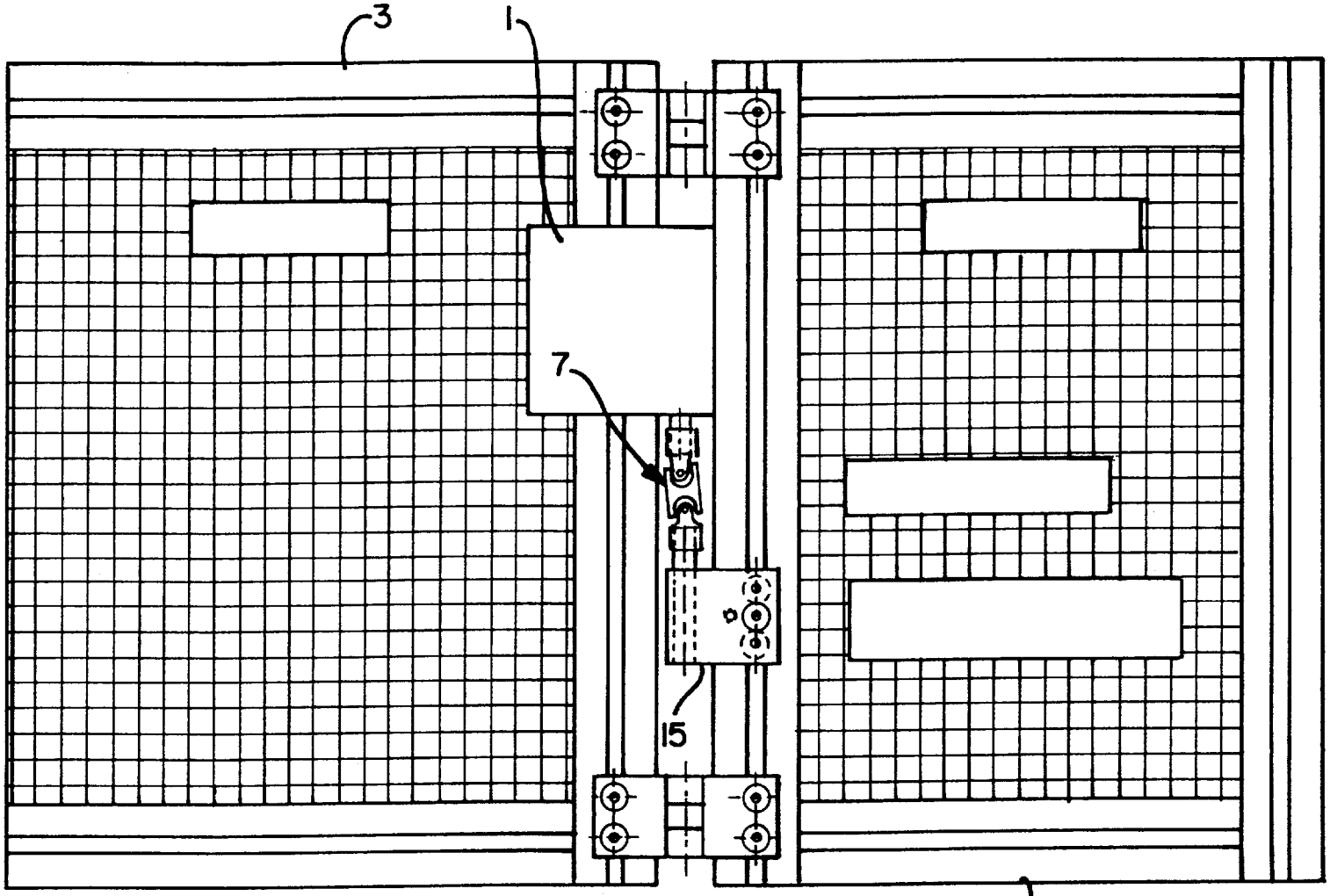

Referring to FIG. 7, in the depicted installation, the switch unit 1 is mounted on the fencing 3 rather than being carried on a post as shown in FIG. 6. Thus, in the FIG. 7 installation, the extension 28 is unnecessary.

Figure 8:
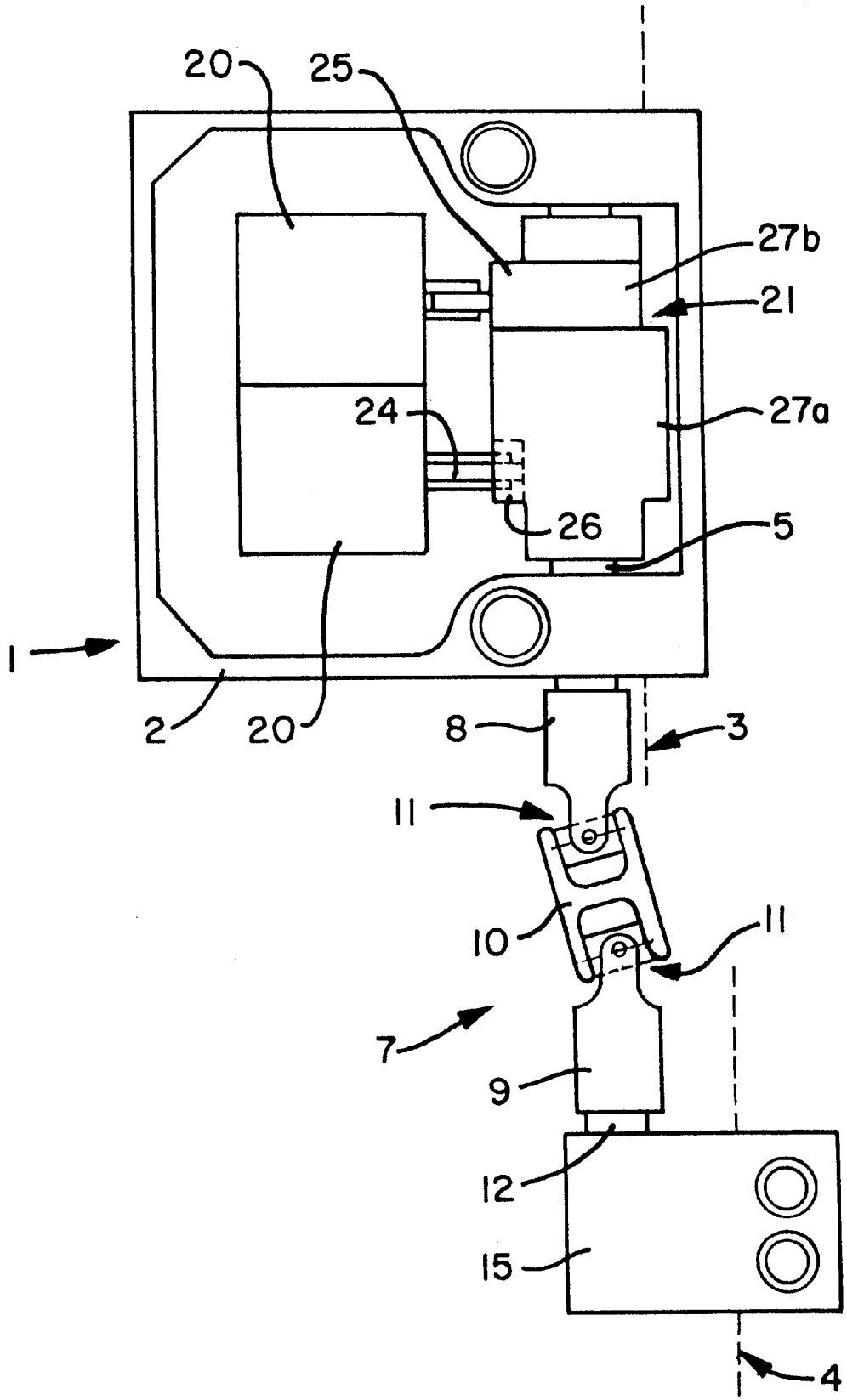
FIG. 8 is a schematic side elevation view of another embodiment of a safety switch device in accordance with the invention.

Referring to FIG. 8, an embodiment of the invention is depicted wherein the actuating shaft 5 carries a roller-shaped actuating cam 21. Cam 21 includes a pair of actuating portions 27*a* and 27*b* which are located axially one above the other. The lower actuating portion 27*a* of cam 21 is provided with the detent notch 26 in the cylindrical circumference of the cam. The detent 26, i.e., the recess provided in the periphery of cam portion 27*a*, receives the cam follower portion on the end of the actuator tappet 24 of the one of switches 20 which is actuated when the protective cover is moved from the closed to the open position.

Continuing to refer to FIG. 8, the upper actuating cam portion 27*b* includes a projection 25 which is disclosed as extending outwardly to the radius of the actuating portion of cam portion 27*a*. According, rotation of shaft 5 will cause the switches controlled by cam portions 27*a* and 27*b* to be operated in opposite directions. The principal distinction between the switch unit of FIG. 8 and that discussed above in the description of FIGS. 4 and 5 is that, in the FIG. 8 embodiment, the switches 20 are arranged one above the other in the axial direction of the actuating shaft 5 whereas, in the embodiment of FIGS. 4 and 5, the switches are angularly offset from one another but located in closely adjacent planes in the axial direction of the actuating shaft. The FIG. 8 arrangement permits the use of a very slim housing 2 for the switch unit, i.e., the thickness of the switch unit is determined by the combined thickness of the switches 20 and the front and rear walls of the housing. A switch unit 1 of the type depicted in FIG. 8 can be mounted on a fixed machine part 3 anywhere between the joints or hinges which are provided for the articulation of the protective cover 4, i.e., the compact nature of the housing does not compromise the ability to pivot the cover.

Figure 9:
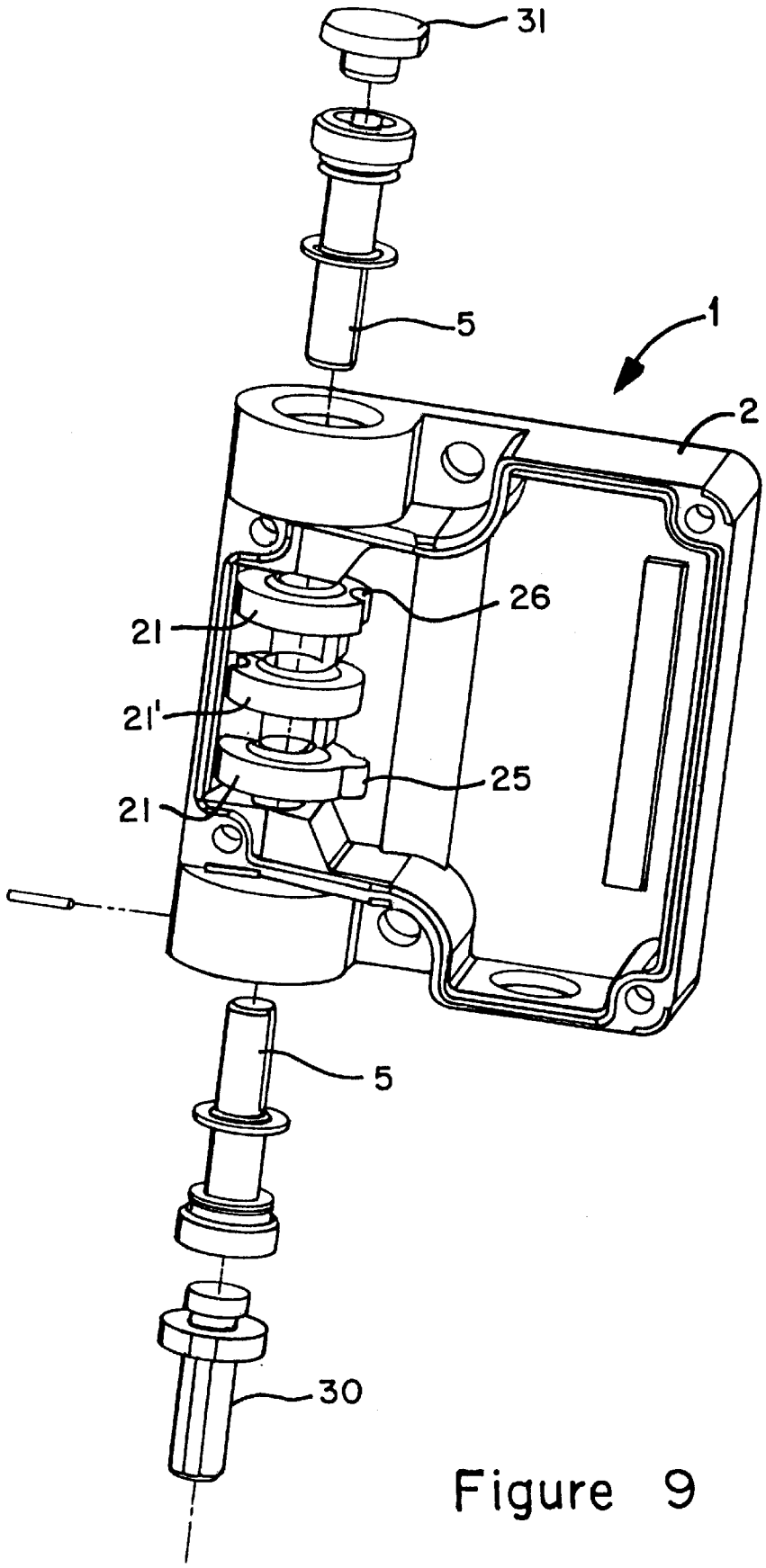
FIG. 9 is an exploded, perspective view of yet another embodiment of a safety switch device in accordance with the invention.
Figure 11:
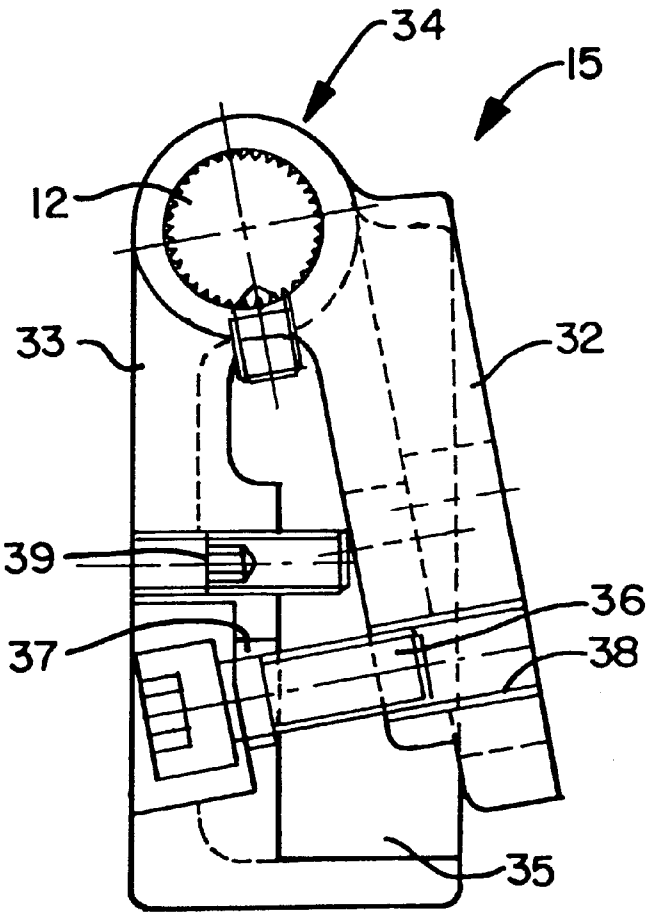
FIGS. 10 and 11 are views similar to FIG. 3 which illustrate an alternative fastening element for use in the implementation of the present invention, the fastening element being shown in different positions in each of FIGS. 10 and 11.
Figure 10:
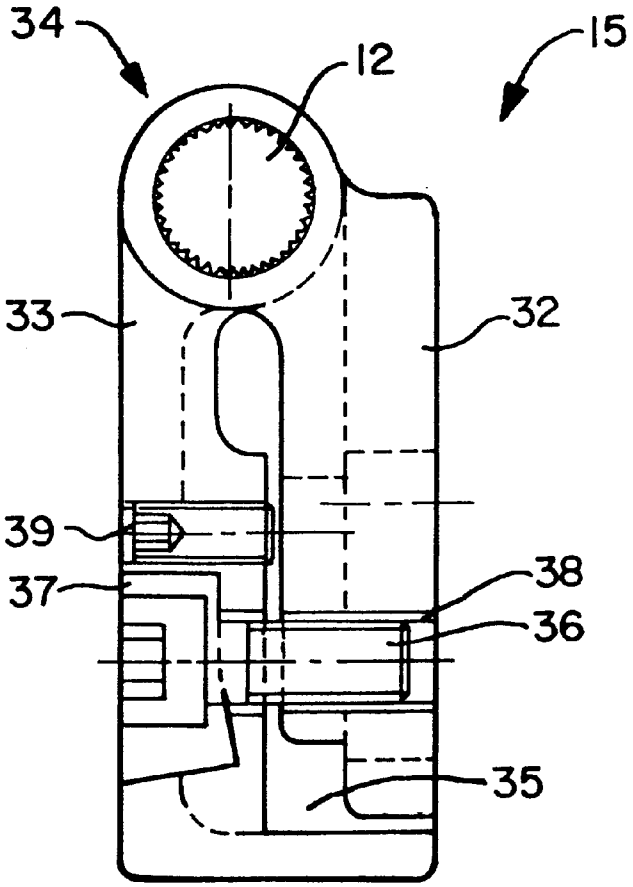
Figure 12B:
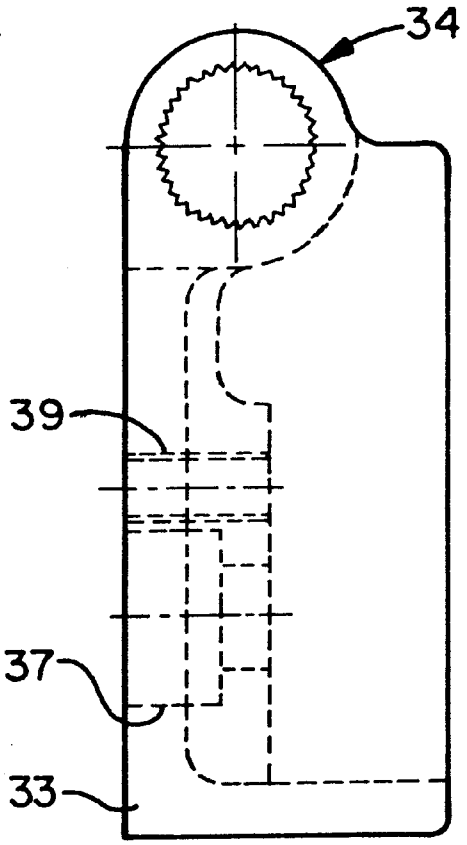
FIGS. 12A and B comprise top and side elevation views of first jaw member of the fastening element of FIGS. 10 and 11.
Figure 12A:
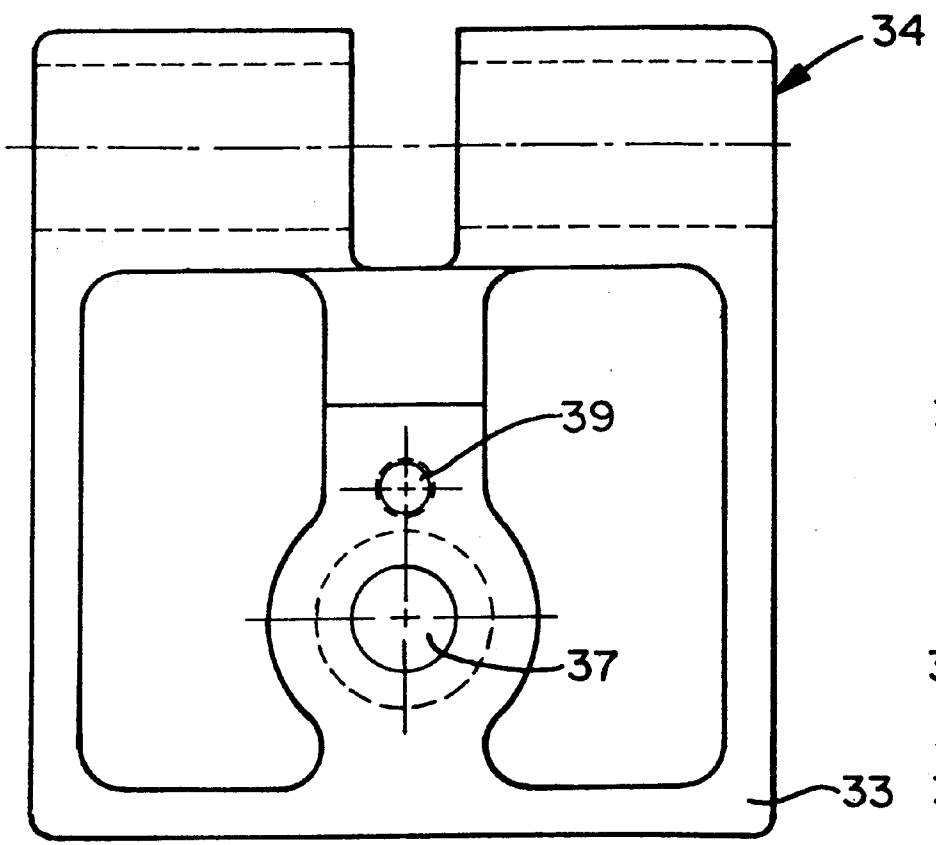
Figure 13B:
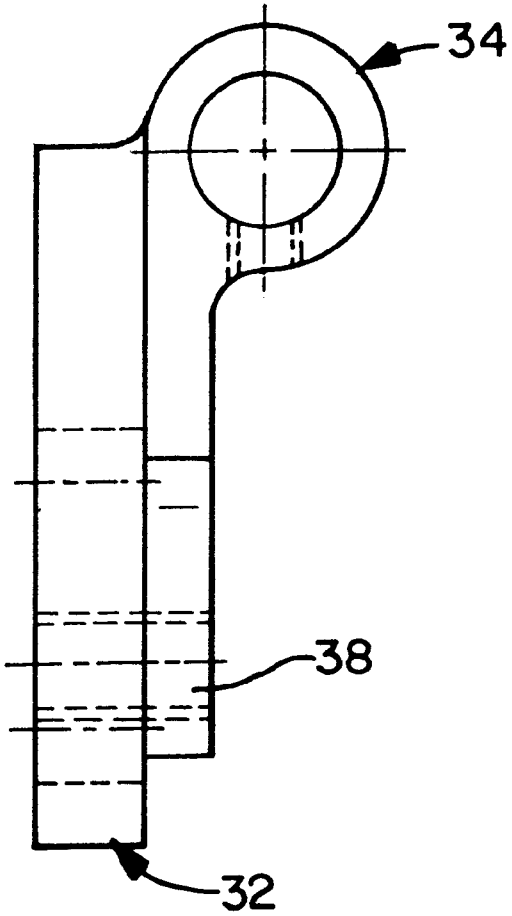
FIGS. 13A and B comprise views, similar to FIG. 12, of the second jaw member of the fastening element of FIGS. 10 and 11.
Figure 13A:
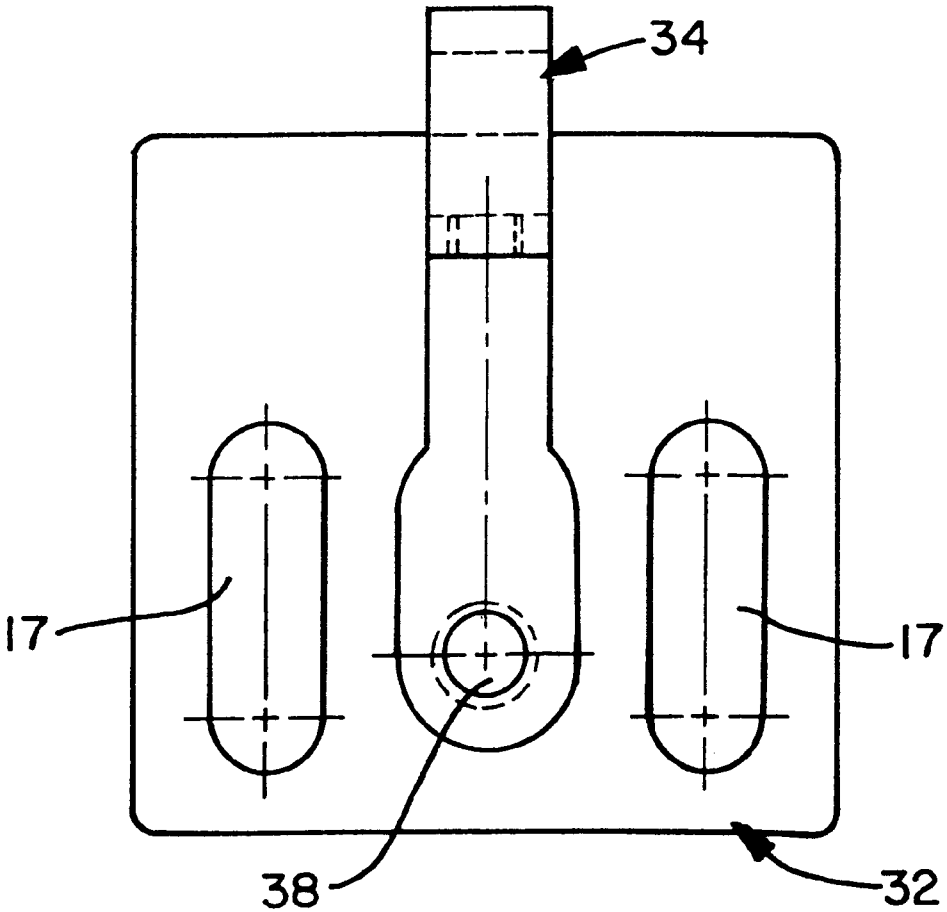

In the arrangement depicted in FIG. 9, the switch unit 1 receives actuating shafts 5 which extend from both ends of the housing 2. In the FIG. 9 embodiment, in addition to the switch actuating cams 21 of the above-described examples, an additional actuating cam 21', is provided. As disclosed, cam 21' includes a detent notch for cooperation with a third switch mounted within the housing 2. Such a third switch may be utilized for purposes of redundancy, i.e., added safety. The intermediate or additional cam 21' may also function, either additionally or solely, to provide a mechanical connection between the actuating shafts 5 which extend into the housing from the top and bottom. The actuating shafts 5 are, at least in part, tubular for reception of either an extension shaft 30 from a connecting element 7 or a protective end cap 31. As will be obvious to those skilled in the art, the provision of a pair of actuating shafts 5 which project from opposite sides of the housing 2 permits switch unit 1 to be located above or below a fastening element 15. Also, by elimination of the mechanical connection between the shafts 5, a single switch unit 1 may be employed to simultaneously monitor the state of two separate protective covers or the like.

FIGS. 10–13 depict an alternative fastening element 15 in accordance with the invention. This fastening element comprises a pair of jaws 32, 33 which are pivotally interconnected via a hinge, indicated generally at 34. The axle 12, see FIGS. 1 and 6–8, defines the axis of rotation of hinge 34. The jaw 33 is provided with a recess 35 which, in part, is complementary in shape to jaw 32. Thus, in the condition depicted in FIG. 10, the jaw 32 is in part received in the recess in jaw 33. The slots 17 (see FIGS. 2 and 3) are provided in jaw 32. The mounting bolts received in slots 17 are covered by jaw 33 when the apparatus is assembled and are thus essentially tamper-proof. The jaws 32, 33 are interconnected by means of a bolt 36 which is received, in a countersunk manner, in a recess 37 provided therefor in jaw 33. The bolt 36 engages a threaded bore 38 provided in jaw 32, adjustment of bolt 36 relative to jaw 32 being permitted when jaw 32 is pivoted slightly with respect to jaw 33. Jaw 33 also receives a set screw 39 which contacts a side face of jaw 32. The set screw 39 may be adjusted, as can be seen by comparison of FIGS. 10 and 11, that the relative positions of jaws 32 and 33 can be set via the bolt 36.

A safety switch in accordance with the present invention can be easily assembled and adjusted. Thus, the jaw 32 can be affixed to the protective cover 4 by means of the mounting bolts 14 and the position of jaw 33 relative to jaw 32 then set. It will thus be obvious to those skilled in the art that a safety switch device in accordance with the present invention can be retrofitted to a protective cover 4 and/or a fixed part 3 of a machine housing without the need for any additional complicated parts.

While preferred embodiments have been shown and described, various modifications and substitutions may be made thereto without departing from the spirit and scope of the present invention. Accordingly, it is to be understood that the present invention has been described by way of illustration and not limitation.

What is claimed is:

1. In a safety switch device for generating signals commensurate with the position of a protective cover which is pivotal about an axis, the switch device including at least a first electrical signal generator, the position of the signal generator relative to the axis about which the cover pivots being fixed, the switch device further having an actuator which rotates about an axis, rotation of the actuator between first and second positions causing the signal produced by the signal generator to change, the improvement comprising:

a fastening element;

means for affixing said fastening element to said pivotal protective cover whereby the fastening element will be positioned on and move with the cover; and motion transmitting means connected to said fastening element and to the actuator of the switch device for establishing an articulated mechanical connection between said fastening element and the actuator of the switch device, said motion transmitting means being movable in at least two planes whereby the position of said fastening element on the protective cover is independent of the axis about which the protective cover pivots and alignment of the axis of rotation of the switch actuator with the connection between said motion transmitting means and said fastening element is not required.

2. The improved safety switch device of claim 1 wherein the actuator comprises a shaft and wherein said motion transmitting means includes means establishing a releasable coupling to the actuator shaft.

3. The improved safety switch device of claim 2 wherein the actuator of the switch device comprises a second actuating shaft and wherein said apparatus further comprises:

means for establishing a mechanical connection between said actuating shafts whereby rotation of one of said actuating shafts results in rotation of the other of said actuating shafts.

4. The improved safety switch device of claim 1 wherein the first electrical signal generator comprises a switch having two states and wherein the actuator includes a cam which cooperates with said switch to determine the state thereof.

5. The improved safety switch device of claim 1 wherein said motion transmitting means defines a Cardan joint.

6. The improved safety switch device of claim 5 wherein said fastening element includes:

a support member;

an axle mounted in said support member, a first end of said axle projecting from said support member; and means for preventing relative rotation between said axle and said support member, said rotation preventing means securing said axle to said support member and permitting selection of the length of said axle which extends from said support member, said first end of said axle being engaged by said Cardan connection.

7. The improved safety switch device of claim 6 wherein the first electrical signal generator comprises a switch having two states and wherein the rotatable actuator includes an actuator cam which cooperates with said switch to determine the state thereof.

8. The improved safety switch device of claim 1 wherein said fastening element includes:

a support member; and an axle mounted in and projecting from said support member, said axle being engaged by said motion transmitting means; and wherein said means for affixing includes:

at least a pair of mounting bolts which engage the protective cover, the position of said support member relative to said mounting bolts being variable.

9. The improved safety switch device of claim 5 wherein said fastening element includes:

a support member; and an axle mounted in and projecting from said support member, said axle being engaged by said motion transmitting means; and wherein said means for affixing includes:

at least a pair of mounting bolts which engage the protective cover, the position of said support member relative to said mounting bolts being variable.

10. The improved safety switch device of claim 1 wherein said fastening element comprises a pair of relatively movable jaws, said jaws being at least in part capable of overlapping.

11. The improved safety switch device of claim 10 wherein said fastening element further comprises an axle, jaws are mounted on said axle, said axle being engaged by said motion transmitting means.

12. The improved safety switch device of claim 11 wherein a first of said jaws is affixed to the protective cover by means of mounting bolts, and wherein the other of said jaws covers said mounting bolts when said safety switch device is in the assembled condition.

13. The improved safety switch device of claim 12 wherein said fastening element further comprises:

means for rotatably adjusting the rotational position of said first jaw with respect to said other jaw, said rotatable position adjusting means including a setscrew which threadable engages said other jaw and contacts said first jaw.

14. The improved safety switch device of claim 13 wherein said motion transmitting means defines a Cardan connection.

15. The improved safety switch device of claim 14 wherein the first electrical signal generator comprises switch means having two states and wherein the movable actuator includes first actuator cam means for cooperating with said switch means to determine the state thereof.

16. A safety switch device for generating signals commensurate with the position of a protective cover, the cover being pivotal about an axis between open and closed positions, said safety switch device comprising:

at least first and second electrical switches, each of said switches having at least two states whereby each of said switches will provide at least two output signals, the positions of said switches relative to the axis about which the protective cover rotates being fixed;

a first actuator cam for controlling the state of said first switch, said first actuator cam being rotatable about an axis;

a second actuator cam for controlling the state of said second switch, said second actuator cam being rotatable about the same axis as said first actuator cam, said first and second actuator cams being axially displaced from one another along their common axis of rotation;

a fastening element;

means for affixing said fastening element to a pivotal protective cover whereby the fastening element will be positioned on and move with the cover; and motion transmitting means connected to said fastening element and to said cams for establishing an articulated mechanical connection between said fastening element and said first and second actuator cams, said motion transmitting means being movable in at least two planes whereby the position of said fastening element on the protective cover is independent of the axis about which the protective cover pivots and alignment of the axis of rotation of said actuator cams with the connection between said motion transmitting means and said fastening element is not required.

17. The safety switch device of claim 16 wherein said first switch provides a signal commensurate with the closed position of the protective cover and wherein said second switch provides a signal commensurate with an open position of the protective cover.

18. The safety switch device of claim 16 wherein said first and second actuator cams each have a peripheral surface with a generally cylindrical shape and wherein said actuator cams are coaxial.

19. The safety switch device of claim 18 wherein one of said actuator cams includes a peripheral surface portion of reduced diameter commensurate with a first state of a first of said switches and wherein the second of said actuator cams has a peripheral surface projection with a maximum diameter commensurate with a first state of the second of said switches.

20. In a safety switch device for generating signals commensurate with the position of a protective cover which is pivotal about an axis, the switch device including at least a first electrical signal generator, the position of the signal generator relative to the axis about which the cover pivots being fixed, the switch device further having an actuator which rotates about an axis, rotation of the actuator between first and second positions causing the signal produced by the signal generator to change, the improvement comprising:

a fastening element;

an axle mounted in said fastening element, a first end of said axle projecting from said fastening element;

means for preventing relative rotation between said axle and said fastening element, said rotation preventing means securing said axle to said fastening element and permitting selection of the length of said axle first end which projects from said fastening element;

means for affixing said fastening element to a pivotal protective cover whereby the fastening element will be positioned on and move with the cover; and motion transmitting means connected between said first end of said axle and to the actuator of the switch device for establishing an articulated mechanical connection between said axle and the actuator of the switch device, said motion transmitting means engaging said first end of said axle and being movable in at least two planes whereby the position of said fastening element on the protective cover is independent of the axis about which the protective cover pivots and alignment of the axis of rotation of the switch actuator with the connection between said motion transmitting means and said axle is not required.

* * * * *